US009848258B1

(12) United States Patent
Roadley-Battin et al.

(10) Patent No.: US 9,848,258 B1
(45) Date of Patent: Dec. 19, 2017

(54) CLICK AND SLIDE BUTTON FOR TACTILE INPUT

(71) Applicant: Google Inc., Mountain View, CA (US)

(72) Inventors: Philip Dam Roadley-Battin, Oakland, CA (US); Haley Toelle, Oakland, CA (US); Cody Sumter, Palo Alto, CA (US); Alok Chandel, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/014,633

(22) Filed: Feb. 3, 2016

(51) Int. Cl.
*H04R 1/10* (2006.01)

(52) U.S. Cl.
CPC ..... *H04R 1/1041* (2013.01); *H04R 1/1016* (2013.01); *H04R 1/1033* (2013.01)

(58) Field of Classification Search
CPC .... H04R 1/10; H04R 2205/022; H04R 1/105; H04R 5/0335; H04R 2201/10; H04R 2460/13; H04R 1/1016
USPC ..... 381/74, 370–384
See application file for complete search history.

(56) References Cited

U.S. PATENT DOCUMENTS 6,198,821 B1 * 3/2001 Yang ..... H01R 13/70 379/430
8,144,915 B2 3/2012 Hankey et al.
8,350,167 B2 1/2013 Prest et al.
2005/0130697 A1 * 6/2005 Dyer ..... H04M 1/6058 455/550.1
2005/0219221 A1 * 10/2005 Ohkuri ..... G08C 19/00 345/169
2007/0003098 A1 * 1/2007 Martenson ..... H04M 1/05 381/388
2009/0095605 A1 * 4/2009 No ..... H01H 25/002 200/1 B
2010/0304676 A1 * 12/2010 Heo ..... H04M 1/05 455/41.3
2011/0135108 A1 * 6/2011 Chien ..... H04R 1/1041 381/74
2013/0118877 A1 5/2013 Prest et al.
2014/0251023 A1 * 9/2014 Magomedov ..... A61B 5/11 73/779

FOREIGN PATENT DOCUMENTS

CN 203416385 U 1/2014
JP 4852731 B2 1/2012

* cited by examiner

*Primary Examiner* — Suhan Ni
(74) *Attorney, Agent, or Firm* — Lerner, David, Littenberg, Krumholz & Mentlik, LLP

(57) ABSTRACT

An audio accessory may include an earphone, a wire extending from the earphone; an input device in communication with an electronic device; and one or more processors. The input device may include an outer housing a button, and a position sensor. The outer housing may have an outer surface and a channel. The button may be disposed within the channel and configured to move within the channel between a first end of the channel and a second end of the channel. A position sensor may be configured to send a signal when the button moves from the first end of the channel to the second end of the channel. The one or more processors may be configured to receive the signal from the position sensor; and terminate an action being performed by the electronic device when the button moves to the second end of the channel.

20 Claims, 11 Drawing Sheets

400A

400B

CLICK AND SLIDE BUTTON FOR TACTILE INPUT

BACKGROUND

Audio accessories, such as ear buds and headsets, are commonly used with mobile computing devices to allow for hands-free use of a mobile device. Such audio accessories can be wirelessly connected or directly connected to the mobile computing devices through wires extending from the ear buds or headset. Improved methods and devices are needed to improve a user's ability to more easily communicate with the mobile computing device.

BRIEF SUMMARY

Aspects of the disclosure are directed to an audio accessory that includes at least one earphone, at least one wire extending from the earphone; and an input device. The input device can be disposed along the wire and in communication with an electronic device. The input device can further include an outer housing, a button, a position sensor, and one or more processors. The input device may have an outer surface and a channel that extends along at least a portion of the outer surface. The button may be disposed within the channel and configured to move within the channel between a first end of the channel and a second end of the channel. The button may have a surface that faces the outer surface of the outer housing and that is spaced away from the outer surface of the outer housing. The position sensor may be configured to send a signal when the button moves from the first end of the channel to the second end of the channel. The one or more processors can be configured to receive the signal from the position sensor; and terminate an action being performed by the electronic device when the button moves to the second end of the channel.

In one example of this aspect, the housing may be attached to at least a portion of the at least one wire. The position sensor can be a hall sensor that detects the location of a magnet coupled to the input device. The magnet may be positioned on one of the button or the housing and the hall sensor may be positioned on the other of the button or the housing. The button can further include an exterior button surface that overlies the outer surface of the outer housing. An interior arm may be positioned within an interior of the housing and a biasing element may bias the interior arm toward the first end of the channel.

In another example of this aspect, the button may be biased toward the first end of the channel. A spring may be used to bias the button toward the first end of the channel.

In accordance with another example of this aspect, the input device may further include a circuit board. The circuit board may include at least one circuit board contact disposed thereon and the button may further include a first button contact. The button may be displaced in a vertical direction relative to the outer surface of the housing. The first button contact may be in contact with the at least one circuit board contact. Additionally, one or more processors may be configured to receive a contact signal when the first button contact makes contact with the at least one circuit board contact. One or more processors may be configured to instruct the electronic device to initiate another action based upon receipt of the contact signal. The another action can be is selected from the group comprising initiating a voice command on the electronic device and controlling a media player function of the electronic device.

According to another aspect of the disclosure, an input device includes an outer housing, a button, a position sensor, and one or more processors. The outer housing may have an outer surface and a channel that extends along at least a portion of the outer surface. The button may be disposed within the channel and configured to move within the channel between a first end of the channel and a second end of the channel. The button may also include an exterior button surface overlying the outer surface of the outer housing. The exterior button surface may be spaced away from the outer surface of the outer housing. An interior arm may be positioned within an interior of the housing. A biasing element may bias the interior arm toward the first end of the channel. A position sensor may be configured to send a signal when the interior arm button moves between the first end of the channel and the second end of the channel. The one or more processors may be configured to receive the signal from the position sensor, as well as terminate an action being performed by an electronic device in communication with the input device when the button moves to the second end of the channel.

In one example, the position sensor may be a hall sensor that detects the presence of a magnet coupled to the input device. The magnet can be positioned on one of the button or the housing and the hall sensor may be positioned on the other of the button or the housing.

In another aspect of the disclosure, a system includes at least one earbud, a wire extending from the earbud; an input device, and one or more processors. The input device may be disposed along the wire and in communication with an electronic device. The input device may include an outer housing, a button, and a position sensor. The outer housing may have an outer surface and a channel that extends along at least a portion of the outer surface. The button may be disposed within the channel and configured to move within the channel between a first stationary position and a second actuated position. The position sensor can be configured to emit a signal when the button moves between the first stationary position and the second actuated position. The one or more processors can be configured to receive the signal from the position sensor and emit a signal instructing the electronic device to perform a function.

In one example of this aspect, the button may be biased towards one end of the channel. Movement of the button from the first stationary position to the second actuated position may be against a force biasing the button towards one end of the channel.

In another example of this aspect, the button is biased toward a first end of the channel when the button is in the first stationary position.

In yet another example of this aspect, the button further includes an outer button surface that overlies the outer surface of the outer housing, and an interior arm portion positioned within an interior of the housing. The interior arm portion may be connected to a biasing element.

In accordance with another aspect of the disclosure, a method for providing instructions to a computing device connected to an audio accessory includes initiating, by one or more processors, a voice mode of the electronic device based upon depression of a button disposed on an input device attached to the audio accessory; receiving, by one or more processors, a command instructing the electronic device to perform a function; detecting, by one or more sensors, a magnet positioned within the button; determining, by one or more processors, that the button has moved from a first stationary position within a channel of the input device to a second actuated position; and terminating, by one or more processors, the function being performed by the electronic device when the button is moved to the second actuated position.

In one example of this method, the button further comprises an exterior arm overlying a top surface of the input device housing and an interior arm positioned within an interior space of the input device housing. The interior arm may compress a spring positioned at one end of the housing when the button moves from the first stationary position to the second actuated position.

In another example of this method, the step of initiating includes initiating an application on the computing device, and wherein the step of terminating includes closing the application.

DETAILED DESCRIPTION

Overview

Figure 1:
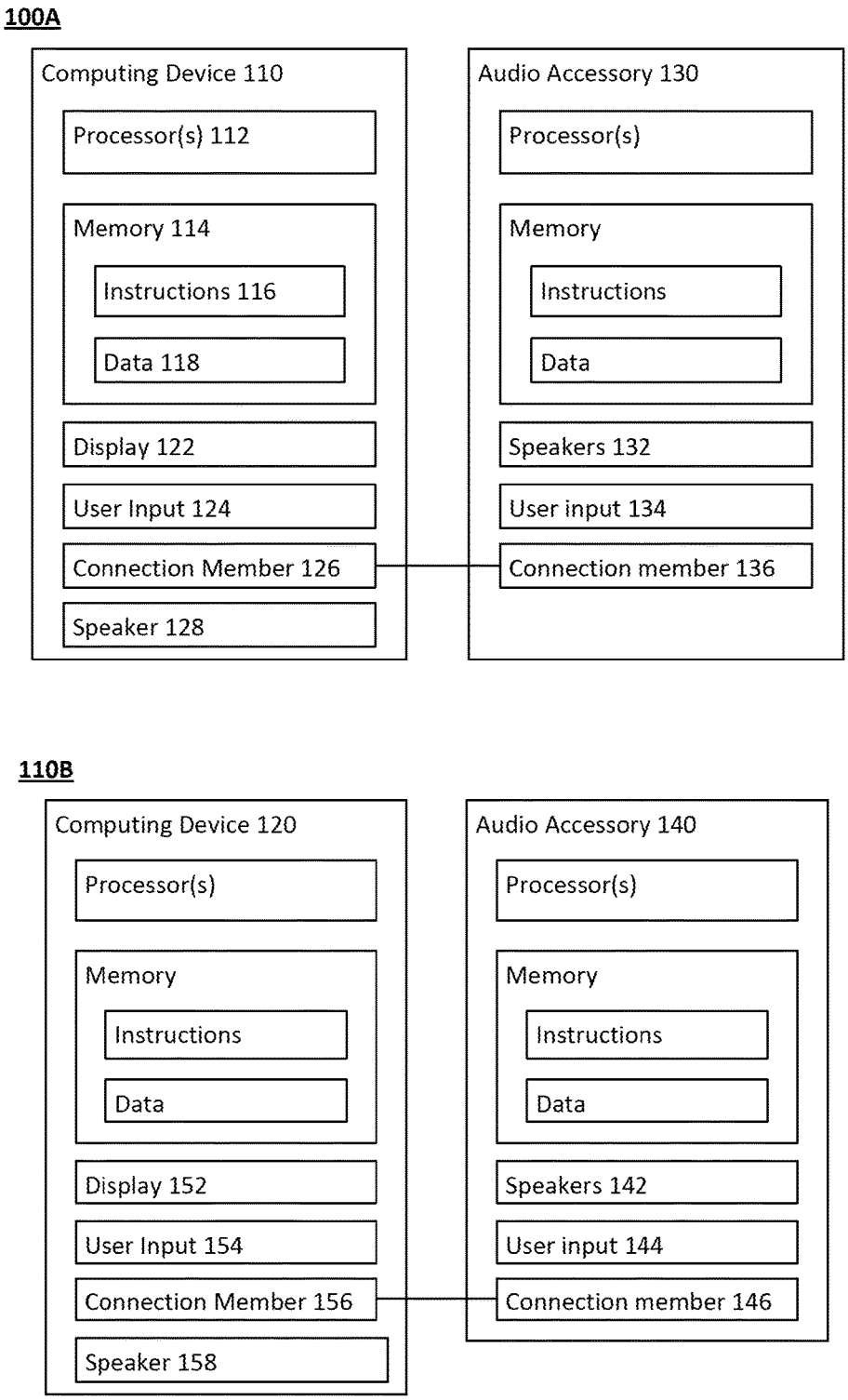
FIG. 1 is a functional diagram of example systems in accordance with aspects of the disclosure.

Aspects of the technology relate to input devices for audio accessories, such as those used for smartphones. Given the limited space available for user inputs on these accessories, the typical configuration for controls on these input devices is a single press button that is inline with the wire of the audio accessory (i.e., an inline input device). For instance, the single press button can be used to provide instructions to a media player for multiple functions, such as a single tap or "click" on the button to play/pause, a double click on the button to play next song, and a triple click on the button to rewind. In some examples, the capability of the single press button can be extended beyond these simple media controls to further include pressing and holding the single button to initiate voice commands.

While use of the single press button can prove beneficial in certain applications, the number of available functions is limited to the number and type of clicking and the availability of initiating voice commands. Voice is not always the most convenient or appropriate way to interact with the device. For example, in very quiet environments, such as meditation rooms, or very loud environments, such as busy streets, or places where it may be socially uncomfortable, a user may not desire to use a voice command to interact with the device. Currently, there is no standard paradigm or device for a user to say "no," cancel, or exit an application without the use of voice or physically operating the electronic device. Furthermore, as audio interfaces become more significant, the user has no way in which to say "yes" or "no" in a tactile matter.

In order to address these shortcomings, aspects of the present disclosure provide an audio accessory including an inline input device with a click and slide button. The click and slide button can be a combined button and slide switch that allows a user to click, hold, and/or slide the button to provide the user with increased functionality over a typical single click button. For instance, the click and slide button may provide a user with the ability to provide additional types of inputs to the electronic device by physically sliding the button in various ways to make various different types of inputs in addition to or rather than requiring that the user utilize voice commands. In other words, providing a button with the ability to slide provides an additional inline tactile input, and eliminates the need for a user to initiate a voice command in order to achieve a particular function or physically handle the smartphone to complete the function. For example, the click and slide button can provide the user with the ability to cancel an action and/or exit an application/mode/function when a user slides the click and slide button.

The audio accessory may be physically or wirelessly connected to a client computing devices, such as a smartphone. An example audio accessory can include a pair of ear phones or ear buds with wires respectively extending from each ear phone. The inline input device may be positioned along one of the respective wires and can provide a user with a way to communicate (directly or indirectly) with the electronic device using tactile inputs (clicks and/or sliding) or a combination of voice and tactile inputs.

An example inline input device may include a housing and a button disposed within an elongated channel in the outer surface of the housing. Electronic components, such as a printed circuit board may be disposed within an interior base of the housing. The button may be used to indirectly communicate with the electronic device by providing instructions to processors within the inline input device or may wirelessly and directly communicate with processors in the electronic device.

The button may be configured to move or slide along the channel between a first stationary position and a second actuated position. The button may be biased to return the button to the first stationary position after the button is placed into the second actuated position.

The audio accessory may include one or more sensors to detect movement of the button along the channel of the input device, such as a hall sensor that is fixed to the housing. When the button is moved from the first end of the channel toward the second end of the channel into the second actuated position, the position sensor can emit a signal indicating movement of the button into the second actuated position. The signal can be received by processors that will send instructions to the electronic device to perform a specific pre-determined function, such as canceling or initiating a particular action being performed by the electronic device. The predetermined functions can include manufacturer pre-set functions, such as media control functions that include "click to play" and "slide to skip to next music track." Additionally or alternatively, predetermined functions can relate to a particular action being performed by the electronic device or an application being run by the device, such as "click to confirm" and "slide to speak again".

When depressed in a vertical or y direction relative to the top surface of the outer housing, button contacts on the button can make contact with the circuit board contacts of the printed circuit board. When the button is in the first stationary position, the button contact can overlie the first circuit board contact. Pressing the button in the "y" or vertical direction can cause the button to move within a vertical channel that may be positioned adjacent the button sidewall. When the button contact contacts the first circuit board contact, a signal can be generated that will instruct the electronic device to perform a pre-determined function.

Similarly, when the button is in the second actuated position, the button contact can overlie a second board contact on the printed circuit board. In the second position, the button can be further depressed in a vertical or y direction relative to the top surface of the outer housing so that the button contact makes contact with the second circuit board contact of the printed circuit board. A signal can be generated that will be received by processors that will instruct the electronic device to perform a pre-determined function.

The features disclosed herein can provide a user with an inline input device that uses a single button with the ability to provide tactile input beyond simple variations on clicking. Because of this, the number of different functions that can be controlled with the inline input device is significantly more than the typical single press button. This then allows a user to control more features on an electronic device without having to utilize voice controls, which can be more convenient for the user.

Example System

Figure 2A:
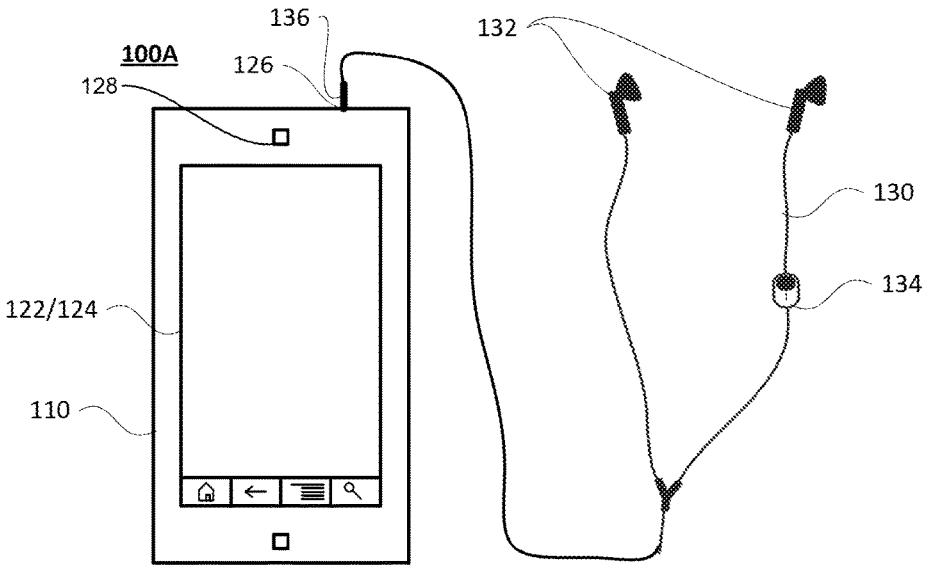
FIG. 2A is a pictorial diagram of the example systems of FIG. 1.
Figure 2A:
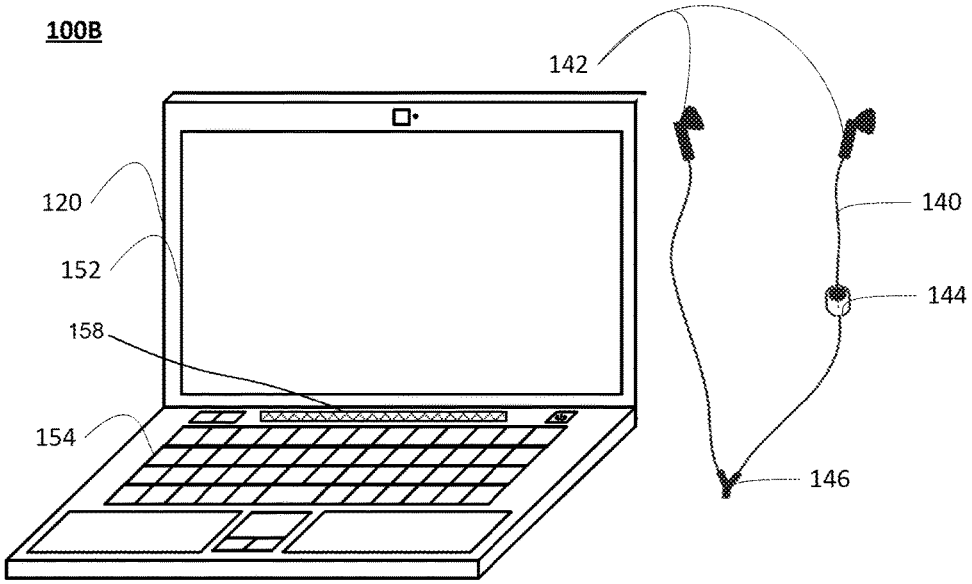

FIGS. 1 and 2A include example systems 100A and 100B in which the features described herein may be implemented. It should not be considered as limiting the scope of the disclosure or usefulness of the features described herein. In this example, system 100 can include computing devices 110, 120, and 130. Each of the computing devices 110, 120, 130 and 140 can contain one or more processors 112 and memory 114 (reference numbers depicted only within computing device 110 for simplicity) as well as various other components as discussed below.

Memory 114 of the computing devices 110, 120, and 130 can store information accessible by the one or more processors 112, including instructions 116 that can be executed by the one or more processors 112. Memory can also include data 118 that can be retrieved, manipulated or stored by the processor. The memory can be of any non-transitory type capable of storing information accessible by the processor, such as a hard-drive, memory card, ROM, RAM, DVD, CD-ROM, write-capable, and read-only memories.

The instructions 116 can be any set of instructions to be executed directly, such as machine code, or indirectly, such as scripts, by the one or more processors. In that regard, the terms "instructions," "application," "steps" and "programs" can be used interchangeably herein. The instructions can be stored in object code format for direct processing by a processor, or in any other computing device language including scripts or collections of independent source code modules that are interpreted on demand or compiled in advance. Functions, methods and routines of the instructions are explained in more detail below.

Data 118 can be retrieved, stored or modified by the one or more processors 112 in accordance with the instructions 116. For instance, although the subject matter described herein is not limited by any particular data structure, the data can be stored in computer registers, in a relational database as a table having many different fields and records, or XML documents. The data can also be formatted in any computing device-readable format such as, but not limited to, binary values, ASCII or Unicode. Moreover, the data can comprise any information sufficient to identify the relevant information, such as numbers, descriptive text, proprietary codes, pointers, references to data stored in other memories such as at other network locations, or information that is used by a function to calculate the relevant data.

The one or more processors 112 can be any conventional processors, such as a commercially available CPU. Alternatively, the processors can be dedicated components such as an application specific integrated circuit ("ASIC") or other hardware-based processor. Although not necessary, one or more of computing devices 110 may include specialized hardware components to perform specific computing processes, such as decoding video, matching video frames with images, distorting videos, encoding distorted videos, etc. faster or more efficiently.

Although FIG. 1 functionally illustrates the processor, memory, and other elements of computing devices 110, 120, 130 and 140 as being within the same block, the processor, computer, computing device, or memory can actually comprise multiple processors, computers, computing devices, or memories that may or may not be stored within the same physical housing. For example, the memory can be a hard drive or other storage media located in housings different from that of the computing devices 110, 120, 130 and 140. Accordingly, references to a processor, computer, computing device, or memory will be understood to include references to a collection of processors, computers, computing devices, or memories that may or may not operate in parallel.

Each computing device 110, 120, 130 and 140 may be a mobile computing device capable of wirelessly exchanging data with a server over a network such as the Internet. For instance, client computing device 110 may be a device such as a mobile phone, wireless-enabled PDA, a tablet PC, or a netbook. Client computing device 120 may be a full a full-sized personal computing device. The client computing devices 110 and 120 may have all of the components normally used in connection with a personal computing device such as processors and memory discussed above as well as a display such as displays 122 or 152 (e.g., a touch-screen, a projector, a television, a monitor having a screen, or other device that is operable to display information), and user input device 124 or 154 (e.g., a mouse, keyboard, touch-screen or microphone). The client computing device 110 and 120 may also include connection members 126 or 156 (shown only in FIG. 1) that facilitate wired, such as via a jack, or wireless connections, such as via WiFi or Bluetooth protocols, with computing devices 130 and 140. The client computing device may also include a camera for recording video streams, speakers, a network interface device, and all of the components used for connecting these elements to one another.

Computing device 130 and 140 may be audio accessory devices configured to communicate via wired or wireless connection with one or more of computing devices 110 or 120. For instance the audio accessory device 130 may include one or more speakers 132 including earphones or earbuds for generating sound, a user an input device 134 to allow a user to input instructions to the audio accessory device and also computing device 110 as discussed below, and a connection member 136, such as an audio jack, for mating with an audio port of computing device 110 (not shown). Similarly, the audio accessory device 140 may include earbuds 142 including one or more speakers for generating sound, a user an input device 144 to allow a user to input instructions to the audio accessory device and also computing device 110 as discussed below, and a connection member 146, such as a wireless transmitter and receiver, for wirelessly communicating information to the processor of computing device 120.

Example Audio Accessory

Figure 3:
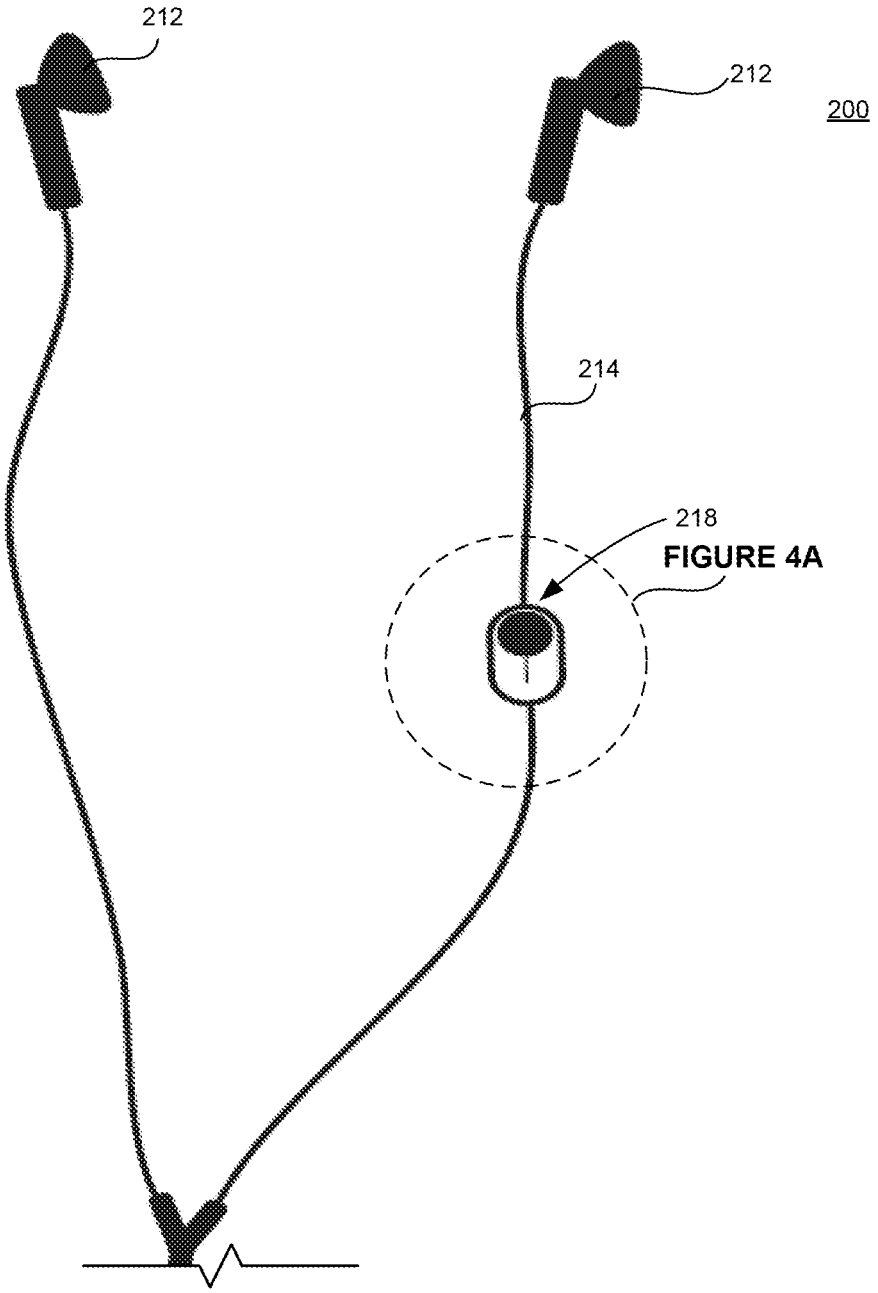
FIG. 3 is a front perspective view of an example audio accessory in accordance with aspects of the disclosure.

An audio accessory 210, corresponding to either audio accessory 130 or 140, as shown in the example 200 of FIG. 3, includes a pair of ear phones or ear buds 212 (corresponding to speakers 132 or 142) with wires 214 respectively extending from each ear bud 212, as well as an input device 218 (corresponding to input device 134 or 144) with a sliding button 226. The input device 218 may be positioned along one of the respective wires 214 and provides a user with the ability to communicate (directly or indirectly) with a client computing device, such as client computing devices 110 or 120, using tactile inputs (clicks and/or sliding) or a combination of voice and tactile inputs.

Figure 2B:
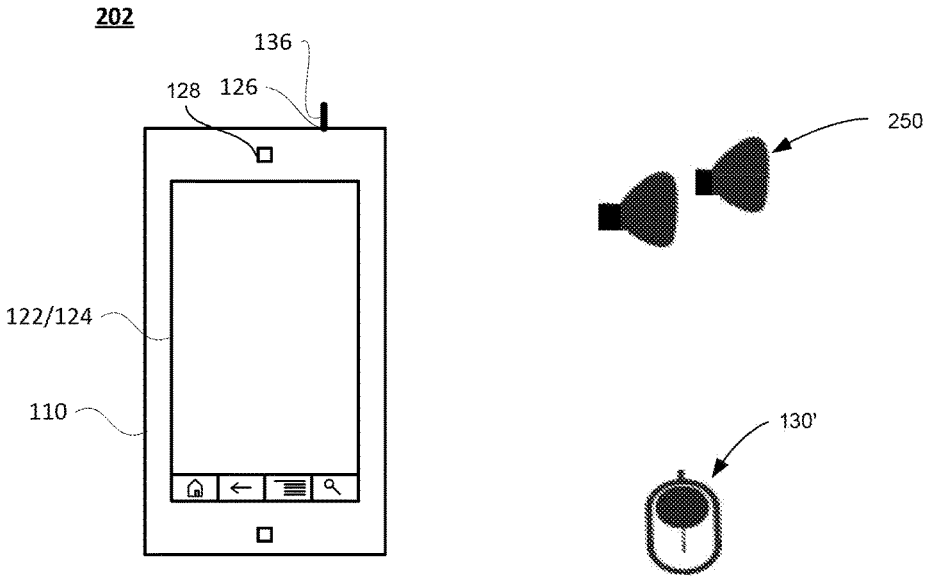
FIG. 2B is a pictorial diagrams of an alternate example system according to aspects of the disclosure.
Figure 2C:
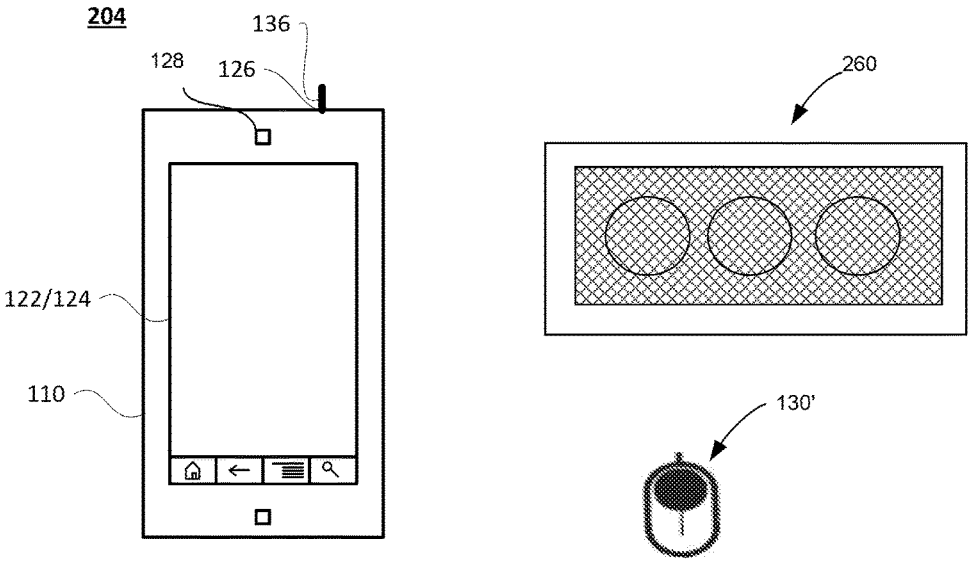
FIG. 2C is a pictorial diagram of an alternate example system according to aspects of the disclosure
Figure 2D:
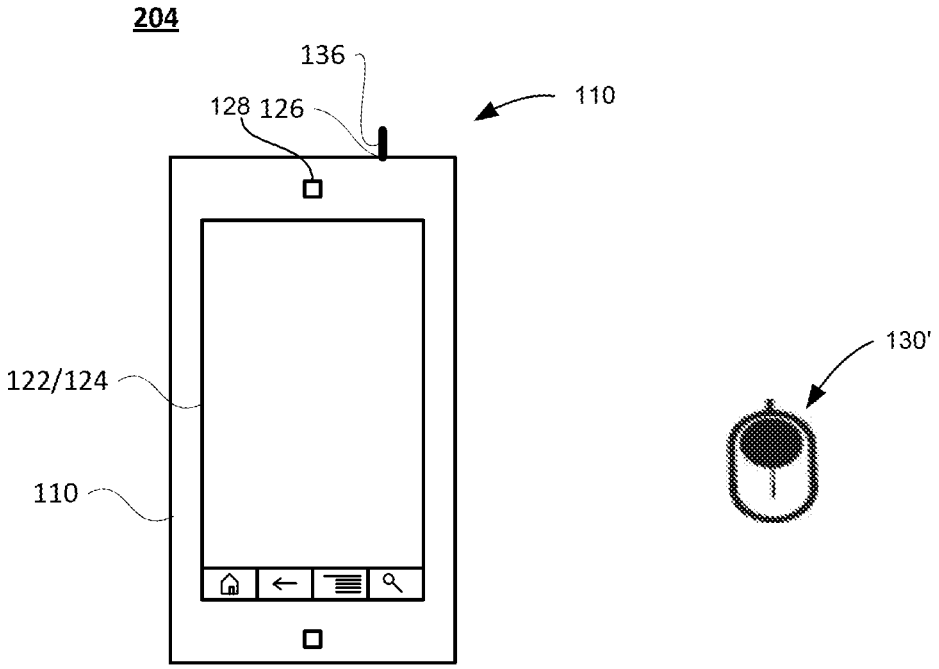
FIG. 2D is a pictorial diagram of an alternate example system in accordance with aspects of the disclosure

The input device 218 is shown as being inline with the wires 214 and ear buds 210, but in other examples, the input device may be a separate and standalone audio accessory that wirelessly communicates with one or more other audio accessories. As shown, for example, in FIGS. 2B, 2C, and 2D, the audio accessory 130' may be similar to audio accessory 130. Although not necessary, in some instances, audio accessory 130' may not include speaker 132 or be physically connected to speaker 132. Audio accessory 130' can wirelessly communicate with one or more other audio accessories, including wireless earbuds 250 (corresponding to speakers 132) (FIG. 2B); a wireless speaker 260 (corresponding to speakers 132) (FIG. 2C); or speaker 128 of computing device 110. Audio accessory 130' can provide a user with a convenient way to communicate with an audio accessory 130' or a computing device 110. Due to its size, the audio accessory 130' can be placed in the pocket of a user, clipped to the clothing of a user, or stored in any other convenient user location.

Figure 4A:
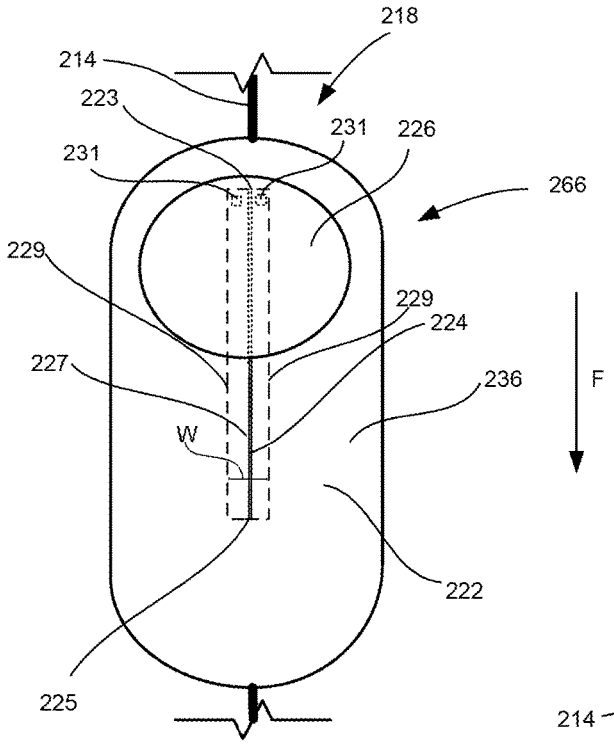
FIG. 4A is a top plan view of an example input device of the audio accessory of FIG. 3 in accordance with aspects of the disclosure.
Figure 4B:
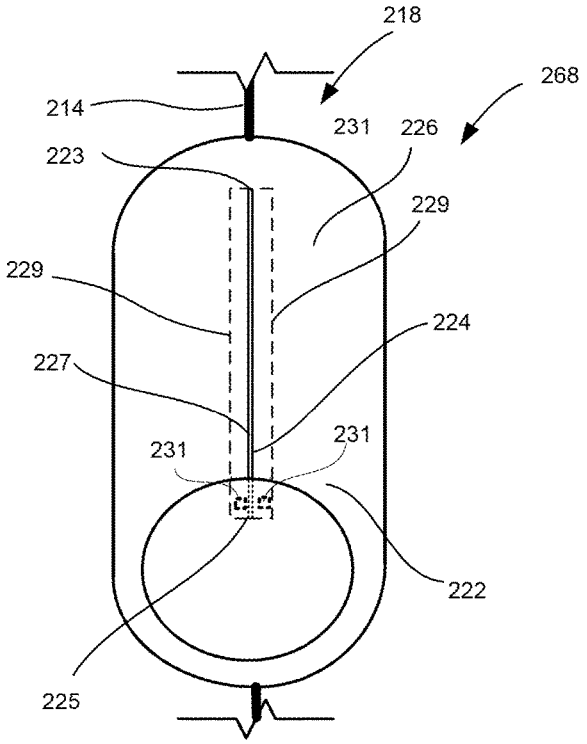
FIG. 4B is a front plan view of the input device of FIG. 4A, with a button of the example input device shown in a second configuration.

An input device 218 may include an outer housing 222, an elongated channel 224, and a sliding button 226 disposed within the elongated channel 224, as shown in the detail views 400A and 400B of input device 218 of FIGS. 4A and 4B. The input device 218 may allow a user to communicate with a computing device, such as computing device 110 or 120. For instance, user input may be sent directly to the processors in the computing devices 110 or 120 or to indirectly to the processors within the input device 218 that provide instructions to the computing devices 110 or 120.

The outer housing 222 may have various configurations. The outer housing 222, as shown for example in FIG. 5, may include an interior base surface 232, an exterior base surface 234, an outer top surface 236, an interior top surface 238, a first end 240 and a second end 242 that is opposite the first end 240. Channel 224 may have a channel opening 227 that extends along a majority of the length of the outer top surface 236 of the outer housing 222. The outer housing 222 can enclose an interior space 244 configured to house various components of the input device 218. The outer housing 222 may be comprised of any number of materials, including a plastic resin.

The overall shape of the outer housing 222 may be oblong with rounded edges, but in other examples, the shape may vary. For example, the outer housing 222 may alternatively be in the shape of a rectangle or a square. The outer housing 222 may be comprised of any number of materials, including a plastic resin.

Electronic components may be disposed within the interior 244 of the outer housing 222. A printed circuit board 248, for example, may be positioned adjacent the interior base surface 232. The printed circuit board 248 can include circuitry necessary for the input device 218 to communicate with the computing devices 110 or 120. The printed circuit board 248 may be a flat and rigid board, but other types of circuit boards, such as a flexible circuit boards can be utilized. A first circuit board contact 250 and a second circuit board contact 252 may be disposed along the outer surface 254 of the printed circuit board 248.

As with the outer housing 222, the sliding button 226 may have various configurations and may be comprised of any number of materials, including a plastic resin. The sliding button 226 may be u-shaped and include an interior arm 256 joined with an exterior arm 258 by a neck 239.

The exterior arm 258 can overlie the top surface 236 of the housing 222. Exterior arm 258 can include an outer contact surface 233 configured to receive a finger of a user and to allow a user to operate the sliding button 226. In one example, the outer surface 233 can be contoured to the shape of a finger or include surface roughenings to facilitate use of the sliding button 226 by a user's finger. An interior contact surface 241 of the exterior arm 258 may be spaced away from the interior top surface 238 of the outer housing 222 by a distance X, which provides the clearance needed for the sliding button to move in a vertical direction between the top and bottom surfaces of the housing.

The interior arm 256 may be an elongated arm positioned within the interior portion 244 of the outer housing 222. A button contact 260 facing toward the interior base surface 232 of the housing may be provided at one end 235 of the interior arm 256. Button tabs 231 may extend from the neck 239 and a magnet 264 may be provided adjacent the button tabs 231, or alternatively, within the one or both button tabs 231. A biasing element, which can include, for example, a spring 262, may be positioned at or near the second end 237 of the interior arm 256. As shown, the spring 262 may be provided around at least a portion of the interior arm 244 to bias the interior arm 256 and the sliding button 226 toward the first end 223 of the channel 224.

The sliding button 226 may be configured to move along the channel 224 between a first stationary position 266 adjacent a first end 250 of the channel 224 (as shown in the example view 400A FIG. 4A) and a second actuated position 268 adjacent a second end 252 of the channel 224 (as shown in the example view 400B FIG. 4B). As shown in FIG. 4A, the channel 224 may have a channel opening 227 extending across the top surface 236, as well as a width W extending between channel sidewalls 229. The neck 239 of the sliding button 226 may be sized to fit within the channel opening 227. The button tabs 231 extending away from the neck 239 and toward the channel sidewalls 229 may be sized to fit within the channel 224.

A position sensor 246 may also be provided on one or both channel sidewalls 229. In one example, the position sensor 246 is a hall sensor, but other types of position sensors may additionally or alternatively be used.

Figure 5:
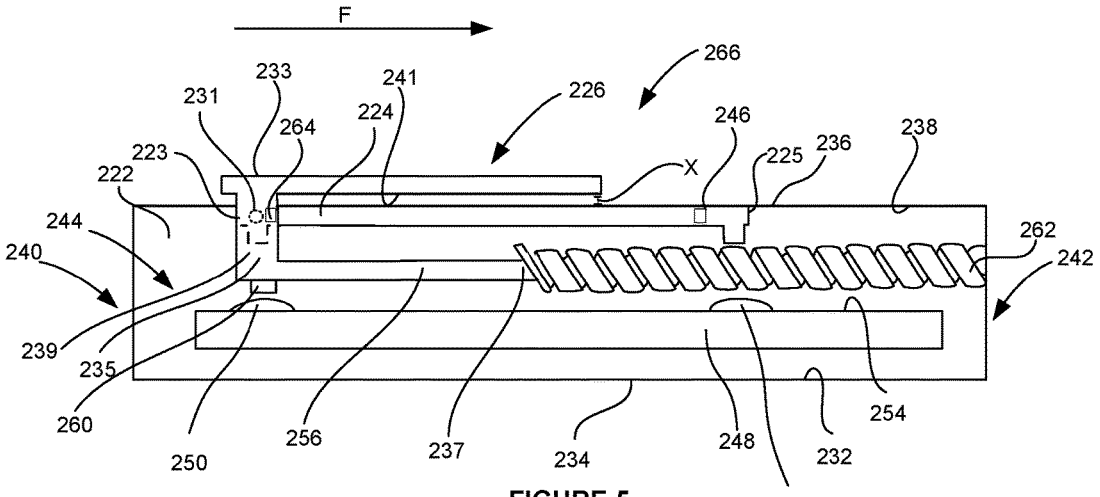
FIG. 5 is a cross sectional view of the input device of FIG. 4A.

The sliding button 226, as shown in FIG. 5, is in an example first stationary position 266 or "resting" position. In the first stationary position 266, the sliding button 226 is positioned adjacent first end 223 of the channel 224 and adjacent the first end 240 of the housing due to the biasing force of the spring 262. In other words, the spring 262 biases the button towards the first end 240 so that the button 226 is at rest in the first stationary position 266. In this position, the button contact 260 of the first interior arm 256 can also directly overlie the first contact 250 on the printed circuit board 248 while in the stationary position 266.

Figure 6:
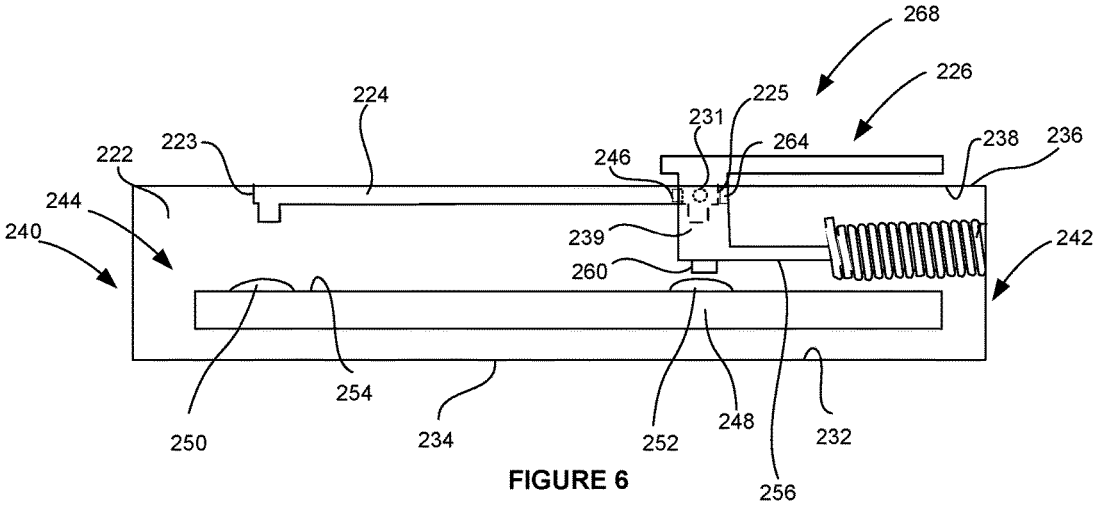
FIG. 6 is a cross-sectional view of the input device of FIG. 4B.

To move into a second actuated position, the sliding button 226 is configured to move within the channel 224 between the first end 240 and second end 242 of the housing 222, as well as between the first end 223 and the second end 225 of the channel. A force F can be applied to the sliding button 226 in a direction that is towards the second end 225 of the channel or a direction which is opposite of the biasing force of the spring 262, so as to overcome the biasing force of the spring towards the first end of the channel 223. The button tabs 231 extending from the neck 239 of the sliding button 226 can guide the sliding button 226 along the channel 224. As shown for example in FIG. 6, the sliding button 226 can be moved from the first stationary position 266, at the first end 223 of the channel 224, along the channel 224 towards the second end 225 of the channel. The sliding button 226 continues to move along the channel 224 until the sliding button 226 reaches the second end 225 of the channel 224.

In one example, the second actuated position is reached when the button tabs 231 contact the second end 225 of the channel 224. As the sliding button 226 slides along the channel 224, the interior arm 256 compresses the spring 262. The spring 262 will continue to compress until the sliding button 226 is positioned adjacent the second end 225 of the channel 224.

In the second actuated position, the spring 262 will continue to bias the sliding button 226 towards the first stationary position. Thus, when the force F is released or removed, the sliding button 226 will return to the first stationary position.

As noted above, the input device 218 may also include a position sensor 246 to detect movement of the sliding button 226 along the channel 224. When the sliding button 226 is moved from the first stationary position 266 at the first end 223 of the channel 224 toward the second end 225 of the channel into the second actuated position 268, the position sensor 246 will detect the change in position of the magnet 264 in the neck 239. In other words, the distance between the magnet and the position sensor will be different when the sliding button 226 is in the first stationary position 266 and when the sliding button is in the second actuated position 268. In this regard, the magnet will also have a first stationary position and a second activated position corresponding to the first stationary position 266 and the second active position 268. Upon detection of a change in a position of the magnet 264 from the first stationary position to the second activated position of the magnet by the position sensor 246, the position sensor will emit a signal indicating movement of the sliding button 226 into the second actuated position 268.

The signal can be received by processors within the input device 218 that will send instructions to the computing device 110 or 120 to perform a first pre-determined command or function, such as canceling or initiating a particular action being performed by the computing device 110 or 120. Alternatively, the signal can be directly received by processors within the computing device 110 or 120.

Figure 7:
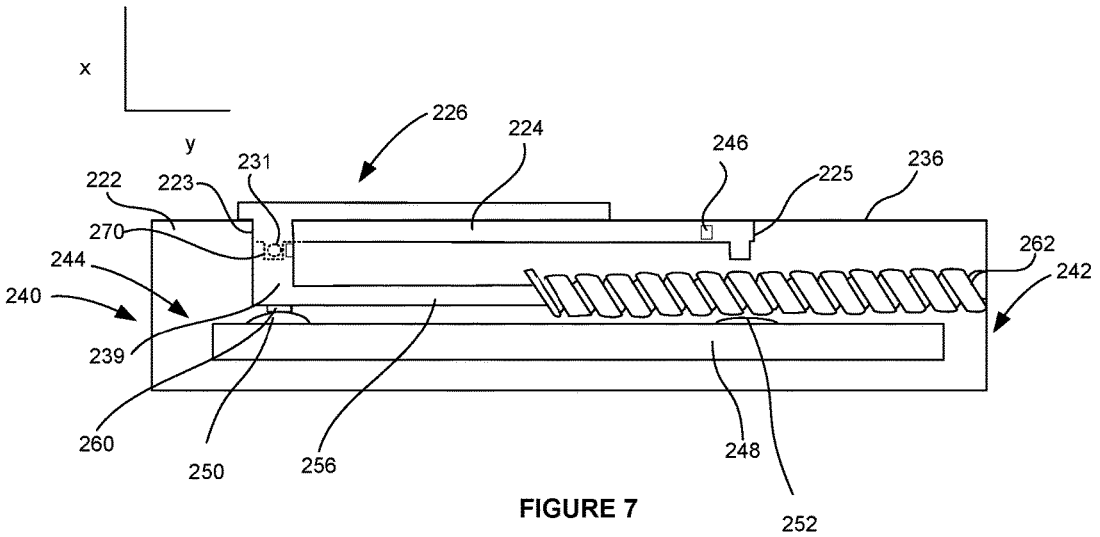
FIG. 7 is a cross-sectional view of the input device of FIG. 4A, where a button of the input device is in a third configuration.

The sliding button 226 may be further depressed in the first stationary position, as well as in the second actuated position, to initiate an action by the client computing device 110 or 120. As shown in the example of FIG. 7, when the sliding button 226 is in the first stationary position 266, the sliding button 226 can be depressed in a vertical or y-direction relative to the top surface 236 of the outer housing 222. Movement of the sliding button 226 in the y-direction causes the button tabs 231 of the sliding button 226 to move into the first vertical channel 270, which extends from the channel 227. Such movement further reduces the distance X (shown in FIG. 5) between the interior surface 241 and top surface 236 of the input device housing 222 so that the interior surface 241 is directly adjacent top surface 236. Returning to FIG. 7, button contact 260 on the sliding button 226 can then make contact with the circuit board contacts 250 of the printed circuit board 248. When the button contact 260 contacts the first circuit board contact 250, a signal can be generated by the circuit board that will instruct the client computing device 110 or 120 to perform a second pre-determined function. For example, the signal may instruct the client computing device 110 or 120 to initiate a voice command prompt.

Figure 8:
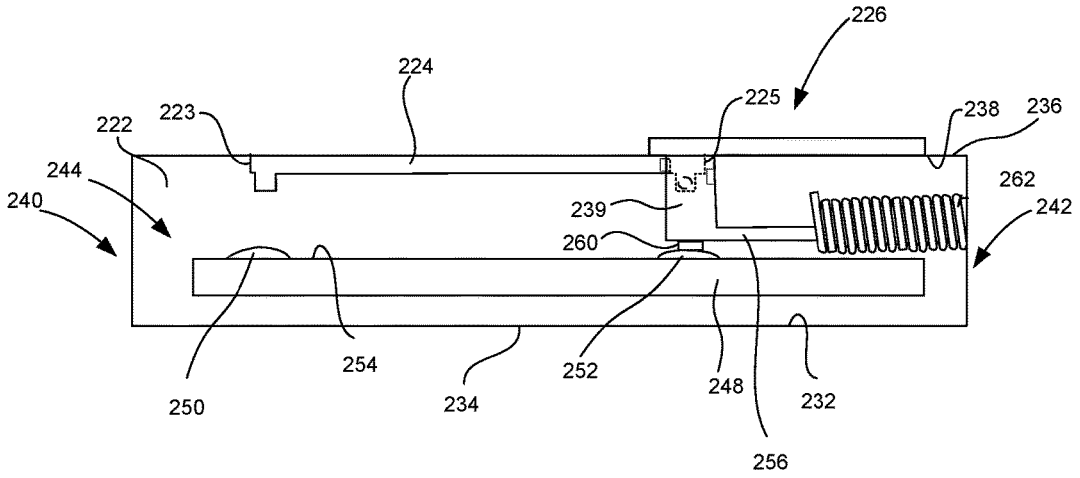
FIG. 8 is a cross-sectional view of the input device of FIG. 4A, where a button of the input device is in a fourth configuration.

Similarly, when the sliding button 226 is in the second actuated position 268, the button contact 260 can overlie the second board contact 252 on the printed circuit board 248. In the second actuated position, the sliding button 226 can also be depressed in a vertical or y-direction relative to the top surface 236 of the outer housing 222, as shown in the example of FIG. 8. When moved in the vertical direction, the button contact 260 can make contact with the second circuit board contact 252 of the printed circuit board 248. A signal can be generated by processors in the printed circuit board that will be received by the client computing device 110 or 120 to perform a pre-determined function. For example, when in the second actuated position, a signal can be generated that instructs the client computing device 110 or 120 to close an application currently running on the client computing device or some other activity currently being executed by the client computing device.

Prolonged depression of the sliding button 226 can initiate yet other pre-determined functions that are to be performed by the client computing device 110 or 120. By way of one example, holding the sliding button 226 depressed for a prolonged period of time causes the button contact 260 to be in contact with the first circuit button contact 250 or second circuit board contact 252 for an extended period of time. The extended period of time may be any pre-set period of time, such as two or more seconds. In one example, prolonged depression of the button 136 while in the first stationary position 266 places the button contact 260 in contact with the first circuit board contact 250 for a prolonged period of time. This prolonged depression can initiate, for example, a voice command mode of the client computing device. Similarly, prolonged depression of the button 136 while in the second actuated position places the button contact 260 in contact with the second circuit board contact 252 for an extended period of time. This prolonged depression can also initiate, for example, a voice command mode of the client computing device 110 or 120.

Rapid successive movement of the sliding button 226 can also initiate other pre-determined functions at the client computing device 110 or 120. For example, rapid successive movement of the sliding button 226 in a vertical or y-direction relative to the top surface 236 of housing while in the first stationary position 266 or the second stationary position 268 can be used to "click" the button and initiate still other functions. In the first stationary position 266, the button contact 260 will rapidly contact the first circuit board contact 250. Similarly, in the second actuated position 268, the button contact 260 will rapidly contact the second circuit board contact 252. The processors can be pre-programmed to recognize the multiple clicks as a particular command or function and send pre-determined signals to the client computing device 110 or 120 based on the number and location (first circuit board contact 250 or second circuit board contact 252).

In another example, rather than the button contact 260 of the sliding button 226 directly contacting the first and second circuit board contacts 250, 252, one or more additional position sensors may be provided within or adjacent the vertical channel 270 in the input device 218 to detect vertical movement of the button in the y direction along the vertical channel 270. The position sensors can, for example, detect the magnet 264 in the neck 239 of the sliding button 226. Detection of vertical movement can send signals and instructions directly or indirectly to the mobile phone to perform a pre-determined function.

As noted above, the input device 218 can be configured to allow a user to provide tactile input to the electronic device to perform a particular function. For example, the input device 218 can be used to initiate an action or discontinue an action or function based on the position of the button 225 at a certain location, as well as the depression of the button 225 at a particular location.

In one example, the input device 218 initiates an action when the sliding button 226 is used as follows: (1) sliding button 226 is depressed in the first stationary position; (2) sliding button 226 is depressed and held down in the first stationary position; (3) sliding button 226 is depressed sequentially two or more times.

The input device 218 can further cancel or discontinue an action or application when the button is used as follows: (1) sliding button 226 is slid from the first stationary position to the second actuated position; (2) sliding button 226 is slid from the first stationary position to the second actuated position and further depressed in the second actuated position; (3) sliding button 226 is slid from the first actuated position to the second actuated positioned and depressed in the second actuated position for a prolonged time period.

In another example, the sliding button 226 can be used to first cancel and then initiate another function when the sliding button is slid from the first actuated position to the second actuated position, and then sequentially depressed in the second stationary position at least two or more times or held down for a prolonged period of time.

Other hardware can be used to support a click and slide motion, as well as other user input gestures noted herein. For instance, the input device of the audio device may additionally or alternatively include touch-based and/or pressure sensitive input, including touch-based and/or pressure sensitive sensors and circuitry. Touch-sensitive and/or pressure sensitive circuitry and sensors may be disposed within the housing such that at least a portion of the outer wall of the housing is configured as a touch-based and/or pressure sensitive input surface. A user may, for example, tap the touch based and/or pressure sensitive input surface or hold a finger for a prolonged period of time, instead of clicking or holding down the button. Additionally, a user may slide a finger across a length of the touch and/or pressure input surface to cancel an action, instead of sliding a button.

Figure 9:
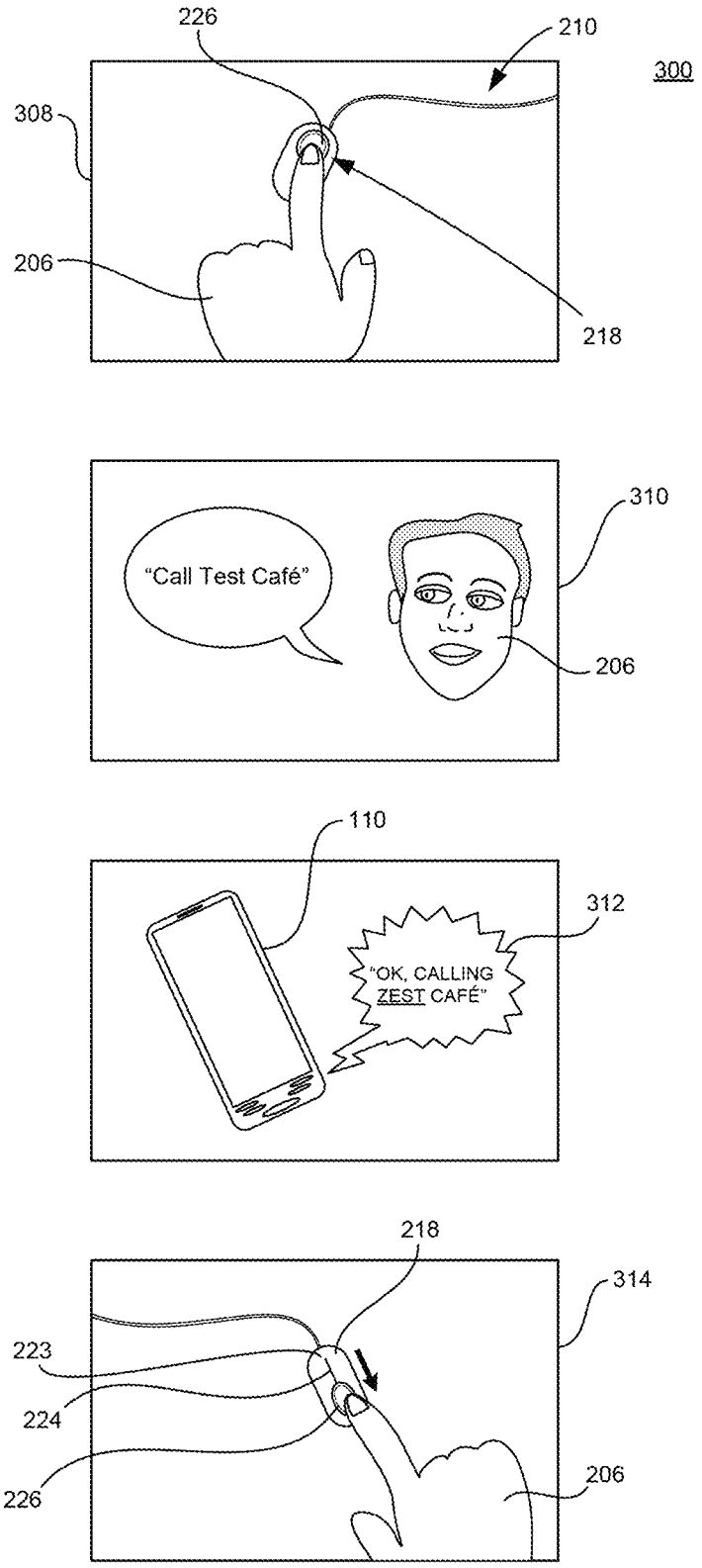
FIG. 9 is an example method in accordance with aspects of the disclosure.

As noted above, the input device 218 can be used to initiate and cancel or discontinue an action being performed by the client computing device 110 or 120. In the example method 300 of FIG. 9, at block 308, the sliding button 226 of audio accessory 210 may be depressed and held in a first stationary position 266 adjacent a first edge of the channel. Prolonged depression of the button 226 can initiate a voice command mode of a client device 110. At block 308, a user 206 may, for example, hold down the sliding button 226 to initiate a voice prompt from client computing device 110 that is wired to the input device 218. At block 310, the user 206 may audibly instruct the client computing device 110 through a microphone on the input device 218 or elsewhere on the audio accessory 310 to "Call Test Café." The client computing device 110 may not have received a clear voice command and may perceive the voice command as instructing the electronic device to call "Zest" Café, instead of "Test" Café. At block 312, the client computing device 110 may audibly respond to the user by indicating, for example, "OK, calling Zest café." Upon recognizing the error, at block 314, a user 206 may cancel the call to Zest Café by sliding the sliding button 226 on the input device 218 from the first stationary position 266 to the second actuated position 268 or from the first end 223 of the channel 224 to the second end 225. Upon receipt of the signal, the client computing device 110 will discontinue calling "Zest Café." This allows a user 206 to easily and quickly cancel a command without having to use a voice command or physically picking up the client computing device 110 and physically using the mobile phone menu or voice commands to instruct the client computing device 110 to cancel the action.

Figure 10:
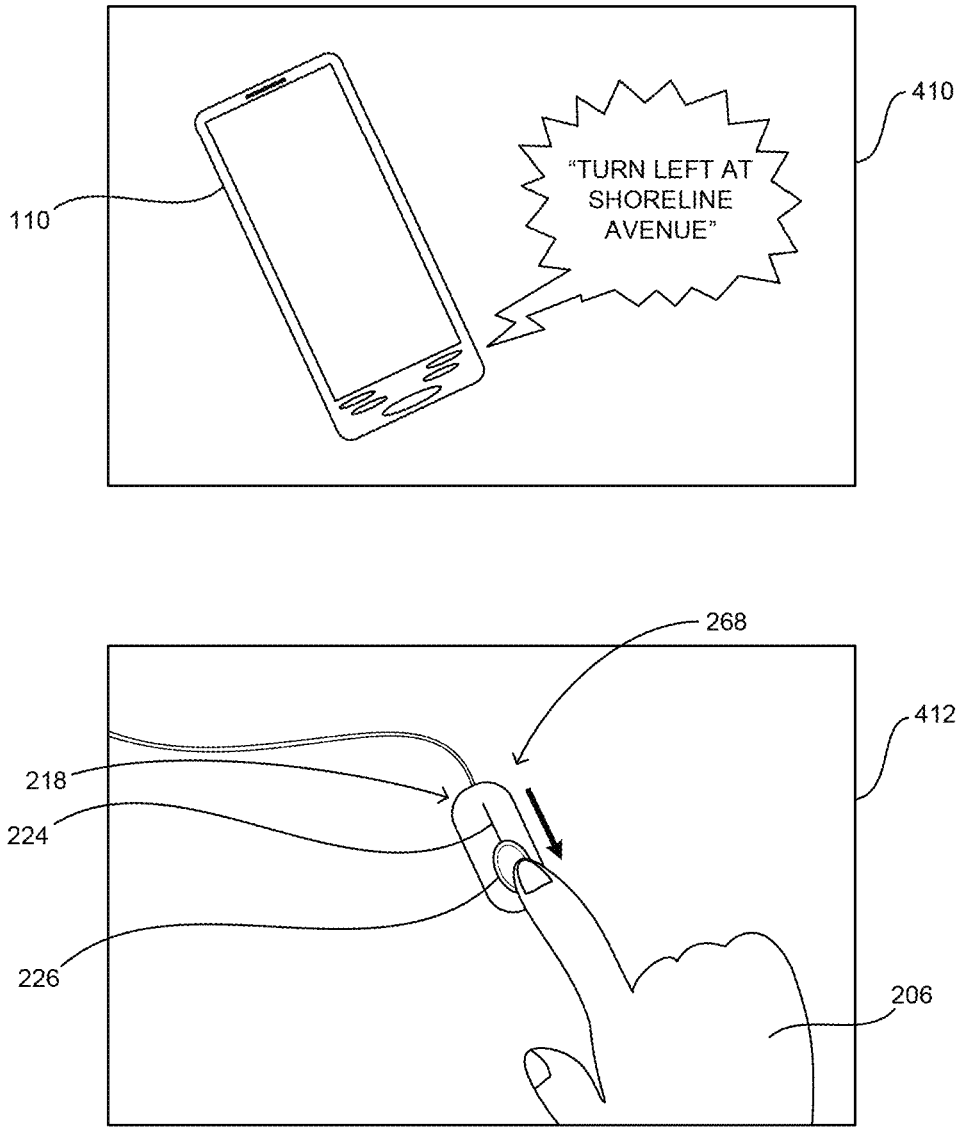
FIG. 10 is an example method in accordance with aspects of the disclosure.

Example 400 of FIG. 10 illustrates a method of using the input device 218 of audio accessory device 210 to both cancel an action and discontinue a running application. For example, a user may already be in the process of using a Global Positioning System ("GPS") application stored in the memory 114 of client computing device 110 to navigate to a specific location. The GPS application may have previously been initiated by directly using the client computing device 110 or using a voice prompt. At block 410, the GPS application running on client computing device 110 may audibly instruct the user to "Turn left at Shoreline Avenue." The user 406 may decide to discontinue use of the GPS application, such as when the user 206 has reached a familiar area or when the user 406 is dissatisfied with the GPS application's instructions. At block 412, to discontinue the GPS application from providing further directions to the current destination without using a voice command or picking up the client computing device 110, the user can slide the sliding button 226 on the input device 218 to the second actuated position 268. Movement of the sliding button 226 along the channel 224 to the second actuated position 268 will send an instruction to the client computing device 110 to discontinue providing instructions. The user 406 may further optionally hold down the sliding button 224 in the second actuated position 268, which further instructs the client computing device 110 to exit the GPS application.

Figure 11:
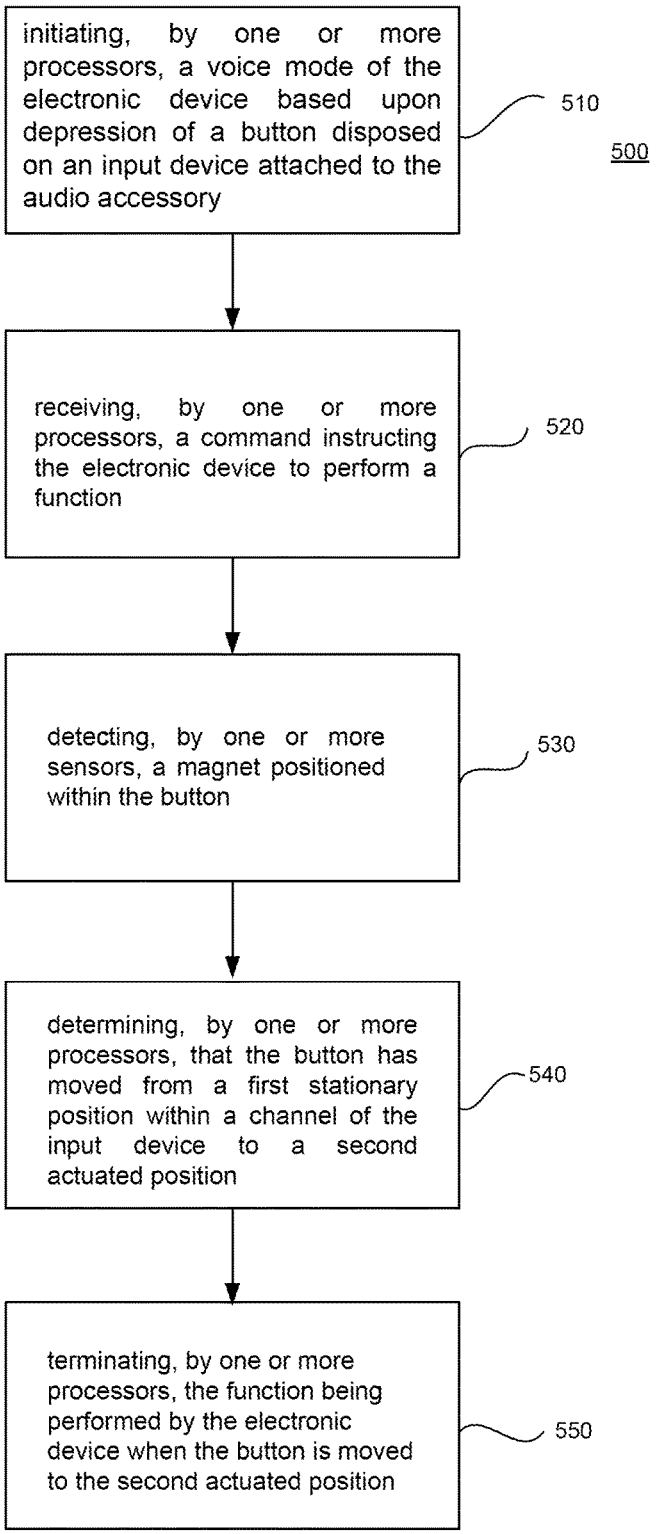
FIG. 11 is an example method in accordance with aspects of the disclosure.

Example 500 of FIG. 11 illustrates another method of using the input device to cancel an action. At block 510, a voice mode of the electronic device is initiated by one or more processors based upon depression of a button of an input device attached to the audio accessory. For example, a user may press a button on an input device for an extended period of time to launch the voice mode of the electronic device.

At block 520, a command instructing the electronic device to perform a function is received by one or more processors. For example, a user may provide a verbal instruction to the electronic device through a microphone positioned on the input device or the audio accessory.

A magnet positioned within the button may be detected by one or more sensors 530 at block 530. For example, a position sensor or hall sensor can be positioned to detect the magnet within the button.

At block 540, a determination may be made by one or more processors, that the button has moved from a first stationary position within a channel of the input device to a second actuated position. For example, when the processors detect the magnet, the processors can make a determination that the button has moved within the channel between first and second positions.

At block 550, the function being performed by the electronic device when the button is moved to the second actuated position may be terminated. For example, if the electronic device was performing a particular function, such as The features disclosed herein can provide a user with an input device that uses a single button with the ability to provide tactile input beyond simple variations on clicking. Because of this, the number of different functions that can be controlled with the input device is significantly more than the typical single press button. This then allows a user to control an electronic device without having to utilize voice controls, which in certain circumstances can be embarrassing or inappropriate.

Although the invention herein has been described with reference to particular embodiments, it is to be understood that these embodiments are merely illustrative of the principles and applications of the present invention. It is therefore to be understood that these and numerous other modifications may be made to the illustrative embodiments and that other arrangements may be devised without departing from the spirit and scope of the present invention as defined by the appended claims.

The invention claimed is:

1. An audio accessory comprising:

at least one earphone;

at least one wire extending from the earphone; and an input device disposed along the wire and in communication with an electronic device, the input device including:

an outer housing having an outer surface and a channel extending along at least a portion of the outer surface;

a button disposed within the channel and configured to move within the channel between a first end of the channel and a second end of the channel, the button having a surface facing the outer surface of the outer housing and being spaced away from the outer surface of the outer housing;

a biasing element biasing the button toward the first end of the channel in a stationary position;

a position sensor configured to send a signal when the button moves from the first end of the channel to the second end of the channel; and one or more processors configured to:

initiate a first action of the electronic device when the button is depressed at the stationary position;

receive the signal from the position sensor; and terminate a second action being performed by the electronic device when the signal from the position sensor is received.

2. The audio accessory of claim 1, wherein the outer housing is attached to at least a portion of the at least one wire.

3. The audio accessory of claim 1, wherein the position sensor is a hall sensor that detects a location of a magnet coupled to the input device.

4. The audio accessory of claim 3, wherein the magnet is positioned on the button and the hall sensor is positioned on the outer housing proximate to the second end of the channel.

5. The audio accessory of claim 1, wherein the button further includes:

an exterior button surface overlying the outer surface of the outer housing; and an interior arm positioned within an interior of the outer housing substantially parallel to the exterior button surface.

6. The audio accessory of claim 5, wherein the biasing element is a spring attached at the second end of the channel and contacting the interior arm of the button.

7. The audio accessory of claim 1, wherein the input device further comprises a circuit board, the circuit board including at least one circuit board contact disposed thereon and the button further including a first button contact, wherein when the button is displaced in a vertical direction relative to the outer surface of the outer housing, the first button contact is in contact with the at least one circuit board contact.

8. The audio accessory claim 7, further comprising:

one or more processors configured to receive a contact signal when the first button contact makes contact with the at least one circuit board contact; and one or more processors configured to instruct the electronic device to initiate another action based upon receipt of the contact signal.

9. The audio accessory of claim 8, wherein the another action is selected from a group comprising initiating a voice command on the electronic device and controlling a media player function of the electronic device.

10. An input device comprising:

an outer housing having an outer surface and a channel extending along at least a portion of the outer surface;

a button disposed within the channel and configured to move within the channel between a first end of the channel and a second end of the channel, the button including:

an exterior button surface overlying the outer surface of the outer housing and spaced away from the outer surface of the outer housing;

an interior arm positioned within an interior of the outer housing substantially parallel to the exterior button surface; and a biasing element biasing the interior arm toward the first end of the channel in a stationary position;

a position sensor configured to send a signal when the button moves between the first end of the channel and the second end of the channel; and one or more processors configured to:

initiate a first action of an electronic device when the button is depressed at the stationary position;

receive the signal from the position sensor; and terminate a second action being performed by the electronic device in communication with the input device when the signal from the position sensor is received.

11. The audio accessory of claim 1, wherein the button is further configured to be depressed into the channel at an actuated position proximate to the second end of the channel, and the one or more processors are further configured to:

perform a third action of the electronic device when the button is depressed at the actuated position.

12. The input device of claim 10, wherein the position sensor is a hall sensor that detects a presence of a magnet coupled to the input device.

13. The input device of claim 12, wherein the magnet is positioned on the button and the hall sensor is positioned on the outer housing proximate to the second end of the channel.

14. A system comprising:

at least one earbud;

a wire extending from the earbud; and an input device disposed along the wire and in communication with an electronic device, the input device comprising:

an outer housing having an outer surface and a channel extending along at least a portion of the outer surface;

a button disposed within the channel and configured to move within the channel between a first stationary position and a second actuated position;

a biasing element providing a force on the button to bias the button to the first stationary position;

a position sensor positioned within the channel proximate to the second end of the channel and configured to emit a signal when the button moves between the first stationary position and the second actuated position; and one or more processors configured to:

initiate a first function of the electronic device when the button is depressed at the first stationary position;

receive the signal from the position sensor; and emit a signal instructing the electronic device to perform a second function based on the received signal.

15. The system of claim 14, wherein movement of the button from the first stationary position to the second actuated position is against the force biasing the button.

16. The system of claim 14, wherein the button further includes an outer button surface overlying the outer surface of the outer housing and an interior arm portion positioned within an interior of the outer housing, the interior arm portion connected to the biasing element.

17. A method for providing instructions to an electronic device connected to an audio accessory, the method comprising:

initiating, by one or more processors, a voice mode of the electronic device based upon depression of a button disposed within a channel on an input device attached to the audio accessory, the depression of the button being at a first stationary position at a first end of the channel, the button being biased towards the first stationary position by a biasing element;

receiving, by the one or more processors, a command in the voice mode instructing the electronic device to perform a function;

detecting, by one or more sensors positioned within the channel proximate to a second end of the channel, a magnet positioned within the button;

sending, by the one or more sensors, a signal based on a position of the detected magnet;

receiving, by the one or more processors, the signal;

determining, by the one or more processors, that the button has moved from the first stationary position towards a second actuated position at the second end of the channel based on the received signal; and terminating, by one or more processors, the function being performed by the electronic device when the button is moved to the second actuated position.

18. The method of claim 17, wherein the button further comprises an exterior arm overlying a top surface of a housing of the input device and an interior arm positioned within an interior space of the input device housing, the interior arm compressing the biasing element positioned at one end of the input device housing when the button moves from the first stationary position to the second actuated position.

19. The method of claim 17, wherein the step of initiating includes initiating an application on the electronic device, and wherein the step of terminating includes closing the application.

20. The method of claim 17, further comprising:

determining, by the one or more processors, the button is depressed at the second actuated position; and closing, by the one or more processors, an application corresponding to the terminated function.

* * * * *